US006553195B2

(12) United States Patent
Korfhage et al.

(10) Patent No.: US 6,553,195 B2
(45) **Date of Patent: *Apr. 22, 2003**

(54) DYNAMIC END SEAL FOR IMAGE FORMING APPARATUS

(76) Inventors: Kurt Matthew Korfhage, 501 Matterhorn Dr., Shelbyville, KY (US) 40065; Michael David Maul, 713 Troy Trail, Lexington, KY (US) 40517; Alexander Douglas Meade, 103 Irvine Rd., Lexington, KY (US) 40502; Tom E Stickler, 416 Dudley Rd., Lexington, KY (US) 40502; Liqun Larry Wang, 1108 Benjamin La., Lexington, KY (US) 40513

( * ) Notice: Subject to any disclaimer, the term of this patent is extended or adjusted under 35 U.S.C. 154(b) by 0 days.

This patent is subject to a terminal disclaimer.

(21) Appl. No.: 09/965,266

(22) Filed: Sep. 27, 2001

(65) Prior Publication Data

US 2003/0059227 A1 Mar. 27, 2003

(51) Int. Cl.[7] ..... G03G 15/08; G03G 21/00

(52) U.S. Cl. ..... 399/102; 399/343; 399/350

(58) Field of Search ..... 399/102, 103, 399/105, 106, 343, 350, 351; 15/256.5, 256.51, 256.52

(56) References Cited

U.S. PATENT DOCUMENTS

| | | | | |
|---|---|---|---|---|
| 3,809,012 | A | * 5/1974 | Delvecchio | 399/102 |
| 4,218,131 | A | 8/1980 | Ito et al. | |
| 4,400,082 | A | 8/1983 | Kiba | |
| 4,498,760 | A | 2/1985 | Sugiyama | |
| 4,564,283 | A | 1/1986 | Fox et al. | |
| 4,616,919 | A | 10/1986 | Adley et al. | |
| 4,681,426 | A | 7/1987 | Bean et al. | |
| 4,779,119 | A | 10/1988 | Kaieda | |
| 4,791,454 | A | 12/1988 | Takahashi et al. | |
| 4,802,928 | A | 2/1989 | Dunlap | |
| 4,819,030 | A | 4/1989 | Shibano | |
| 4,862,209 | A | 8/1989 | Sakamoto et al. | |
| 4,870,449 | A | 9/1989 | Brown | |
| 4,893,151 | A | 1/1990 | Yamazaki et al. | |
| 4,905,047 | A | 2/1990 | Ariyama | |
| 4,937,632 | A | 6/1990 | Kamidaira | |
| 4,947,216 | A | 8/1990 | Surti | |
| 5,021,830 | A | 6/1991 | Koiso | |
| 5,029,316 | A | 7/1991 | Koiso | |
| 5,202,729 | A | 4/1993 | Mivamoto et al. | |
| RE34,384 | E | 9/1993 | Ishiguro et al. | |
| 5,321,473 | A | 6/1994 | Azami | |
| 5,369,477 | A | 11/1994 | Foote et al. | |
| 5,404,216 | A | 4/1995 | Numagami et al. | |
| 5,455,665 | A | 10/1995 | Baba et al. | |
| 5,488,462 | A | 1/1996 | Ishikawa et al. | |
| 5,585,895 | A | 12/1996 | Yashiro et al. | |
| 5,655,178 | A | 8/1997 | Ishikawa et al. | |
| 5,697,021 | A | 12/1997 | Watanabe et al. | |
| 5,697,022 | A | 12/1997 | Matsuda et al. | |
| 5,701,558 | A | 12/1997 | Kojima | |
| 5,758,230 | A | 5/1998 | Nakaue et al. | |

(List continued on next page.)

*Primary Examiner*—Hoan Tran
(74) *Attorney, Agent, or Firm*—Coats & Bennett, P.L.L.C.

(57) ABSTRACT

An end seal for use in an electrophotographic image forming apparatus uses an array of ridges (or grooves) to urge toner inwardly so as to help prevent toner escape. The end seal works in conjunction with a cleaning blade. The end seal includes a blade pocket for mating with the end portions of the cleaning blade and a middle portion having an array of ridges thereon. The ridges are angled inward to urge any toner trapped therebetween inward away from the end seals, where the toner can be directed to a waste reservoir in a normal fashion. This "snowplowing" action of the ridges helps prevent outward migration of toner, thereby minimizing toner escape. The end seal may be composed of two or more layers of differing materials. There may be an end seal at each end of the cleaner blade.

53 Claims, 8 Drawing Sheets

U.S. PATENT DOCUMENTS 5,774,765 A 6/1998 Hirota et al.
5,778,282 A 7/1998 Nagashima
5,805,958 A 9/1998 Fisk
5,805,965 A 9/1998 Tsuda et al.
5,809,374 A 9/1998 Tsuda et al.
5,870,651 A 2/1999 Shimada
5,895,144 A 4/1999 Nishimura
5,895,151 A 4/1999 Kinoshita et al.
5,987,277 A 11/1999 Okabe
6,035,158 A 3/2000 Asakura et al.
6,094,550 A 7/2000 Kido et al.
6,115,565 A 9/2000 Noda
6,178,301 B1 1/2001 Kojima et al.
6,181,897 B1 1/2001 Kawai
6,185,392 B1 2/2001 Hoshi
6,195,515 B1 2/2001 Fujita et al.
6,205,304 B1 3/2001 Kawaguchi
6,212,343 B1 4/2001 Hosokawa et al.
6,341,206 B1 * 1/2002 Yamaguchi et al. ..... 399/103

* cited by examiner

DYNAMIC END SEAL FOR IMAGE FORMING APPARATUS

BACKGROUND OF THE INVENTION

The present invention relates generally to the field of electrophotographic image forming, and more particularly to a seal design for cleaning assemblies of electrophotographic image forming apparatuses that helps prevent toner leakage.

In the electrophotographic printing process, an image forming apparatus, such as a laser printer, selectively exposes a uniformly charged image carrier known as a photoconductor to form a latent image. The latent image is made visible by toner, and the toner image is transferred to a recording medium so that the image may be rendered permanent. In such an apparatus, additional toner must be supplied each time the toner is used up, which may be inconvenient and messy. Also, the presence of toner outside its intended areas may make it necessary to perform maintenance on various parts of the apparatus. As such, significant emphasis is placed on preventing leakage of toner outside its intended areas in the electrophotographic printing process.

SUMMARY OF THE INVENTION

The present invention is directed to an end seal design that uses an array of ridges (or grooves) to urge toner inwardly so as to help prevent outward toner escape, and to cleaning assemblies in an electrophotographic image forming apparatus that employ such an end seal design. Because the end seal according to the present invention does more than merely create a passive barrier to toner, it also actively urges toner in the desired direction, the end seal may be referred to herein as a dynamic end seal.

In a first aspect of the invention, the inventive concept is used on an end seal for a cleaning assembly associated with a photoconductor, such as a common photoconductive drum. The cleaning assembly includes a photoconductive drum, a cleaning blade, one or more end seals, and an optional lower flexible seal. The end seals include a blade pocket for mating with the end portions of the cleaning blade and another portion having an array of ridges thereon. The ridges are angled inward and, when in contact with the photoconductive drum, urge any toner trapped therebetween inward towards the center of the photoconductive drum, where the toner can be directed to a waste reservoir in a normal fashion. This "snowplowing" action of the ridges helps prevent outward migration of the toner, thereby minimizing toner escape. The end seal may be composed of two layers—the layer closest to the photoconductive drum being a relatively firm low friction material, while the layer away from the photoconductive drum being compliant material such as foam. The compliant material helps bias the end seal against the photoconductive drum, the cleaning blade, and the lower flexible seal, and account for surface variations in the nearby housing. There may be, of course, one such end seal at each end of the cleaner blade.

In a second aspect of the invention, the inventive concept is used on an end seal for a cleaning assembly associated with an intermediate transfer medium, such as an intermediate transfer belt. The cleaning assembly includes an intermediate transfer medium, a cleaning blade, one or more end seals, and an optional lower flexible seal. The end seals include a blade pocket for mating with the end portions of the cleaning blade and another portion having an array of ridges thereon. The ridges are angled inward and, when in contact the intermediate transfer medium, urge any toner trapped therebetween inward towards the center of the intermediate transfer medium, where the toner can be directed to a waste reservoir in a normal fashion. This "snowplowing" action of the ridges helps prevent outward migration of the toner, thereby minimizing toner escape. The end seal may be composed of two layers—the layer closest to the intermediate transfer medium being a relatively firm low friction material, while the layer away from the intermediate transfer medium being compliant material such as foam. The compliant material helps bias the end seal against the intermediate transfer medium, the cleaning blade, and the lower flexible seal, and account for surface variations in the nearby housing. There may be, of course, one end seal at each end of the relevant cleaner blade.

DETAILED DESCRIPTION OF THE INVENTION

As the present invention relates to the sealing within an electrophotographic image forming apparatus, an understanding of the basic elements of an electrophotographic image forming apparatus may aid in understanding the present invention. For purposes of illustration, a four cartridge color laser printer will be described; however one skilled in the art will understand that the present invention is applicable to other types of electrophotographic image forming apparatuses that use one or more toner colors for printing. Further, for simplicity, the discussion below may use the terms "sheet" and/or "paper" to refer to the recording media 5; this term is not limited to paper sheets, and any form of recording media is intended to be encompassed therein, including without limitation, envelopes, transparencies, postcards, and the like.

Figure 1:
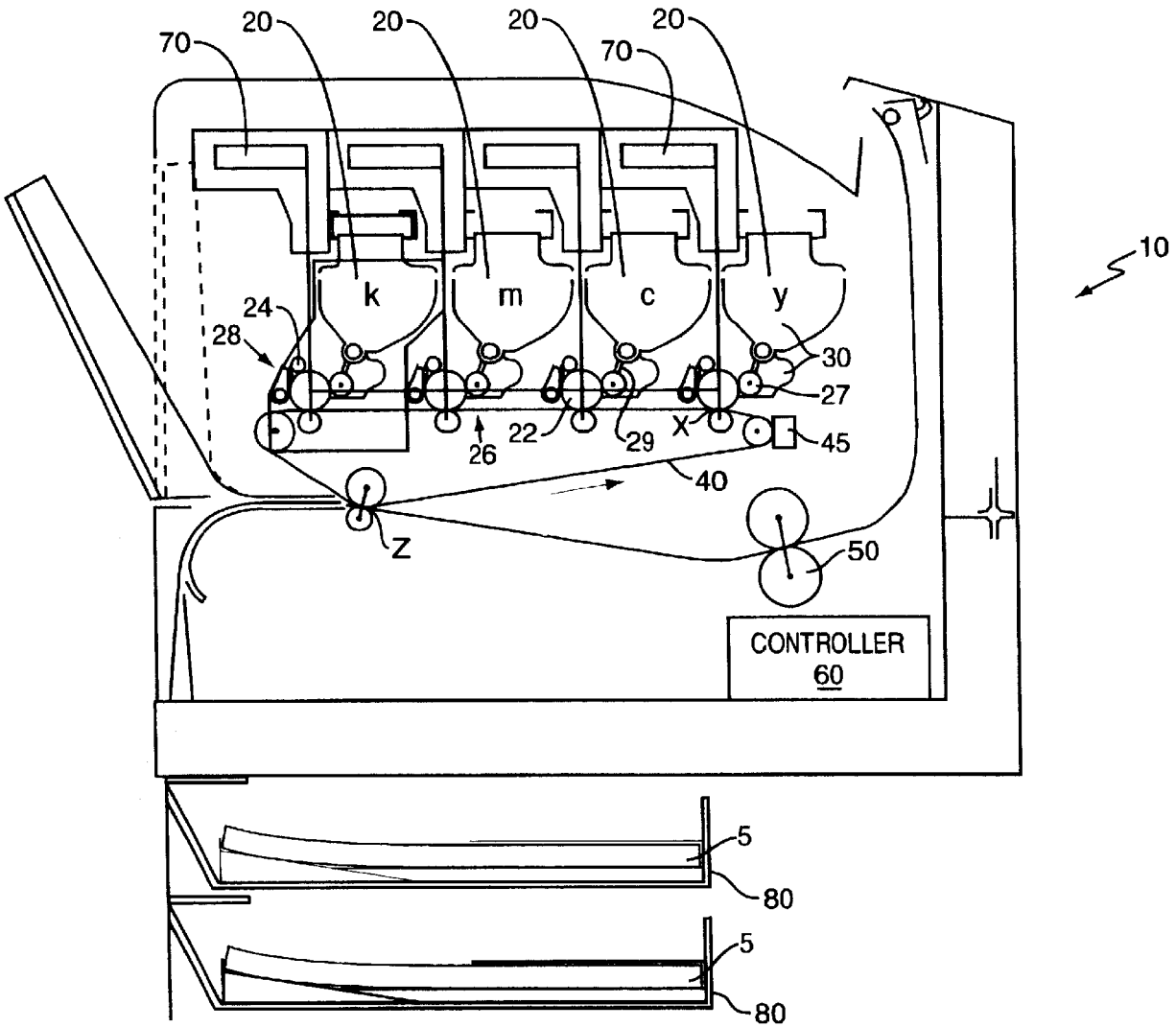
FIG. 1 shows an image forming apparatus.

A four color laser printer, generally designated 10 in FIG. 1, typically includes a plurality of optionally removable toner cartridges 20 that have different toner color contained therein, an intermediate transfer medium 40, a fuser 50, and one or more recording media supply trays 80. For instance, the printer 10 may include a black (k) cartridge 20, a magenta (m) cartridge 20, a cyan (c) cartridge 20, and a yellow (y) cartridge 20. Typically, each different color toner forms an individual image of a single color that is combined in a layered fashion to create the final multi-colored image, as is well understood in the art. Each of the toner cartridges 20 may be substantially identical; for simplicity only the operation of the cartridge 20 for forming yellow images will be described, it being understood that the other cartridges 20 may work in a similar fashion.

The toner cartridge 20 typically includes a photoconductor 22 (or "photoconductive drum" or simply "PC drum"), a charger 24, a developer section 26, a cleaning assembly 28, and a toner supply bin 30. The photoconductor 22 is generally cylindrically-shaped with a smooth surface for receiving an electrostatic charge over the surface as the photoconductor 22 rotates past charger 24. The photoconductor 22 rotates past a scanning laser 70 directed onto a selective portion of the photoconductor surface forming an electrostatically latent image representative of the image to be printed. Drive gears (not shown) may rotate the photoconductor 22 continuously so as to advance the photoconductor 22 some uniform amount, such as 1/600th or 1/1200th of an inch, between laser scans. This process continues as the entire image pattern is formed on the surface of the photoconductor 22.

After receiving the latent image, the photoconductor 22 rotates to the developer section 26 which has a toner bin 30 for housing the toner and a developer roller 27 for uniformly transferring toner to the photoconductor 22. The toner is typically transferred from the toner bin 30 to the photoconductor 22 through a doctor blade nip formed between the developer roller 27 and the doctor blade 29. The toner is typically a fine powder constructed of plastic granules that are attracted and cling to the areas of the photoconductor 22 that have been discharged by the scanning laser 70. To prevent toner escape around the ends of the developer roller 27, end seals may be employed, such as those described in U.S. patent application 09/833,888, filed Apr. 12, 2001, entitled "Dynamic End-Seal for Toner Development Unit," which is incorporated herein by reference.

The photoconductor 22 next rotates past an adjacently-positioned intermediate transfer medium ("ITM"), such as belt 40, to which the toner is transferred from the photoconductor 22. The location of this transfer from the photoconductor 22 to the ITM belt 40 is called the first transfer point (denoted X in FIG. 1). After depositing the toner on the ITM belt 40, the photoconductor 22 rotates through the cleaning section 28 where residual toner is removed from the surface of the photoconductor 22, such as via a cleaning blade well known in the art. The residual toner may be moved along the length of the photoconductor 22 to a waste toner reservoir (not shown) where it is stored until the cartridge 20 is removed from the printer 10 for disposal. The photoconductor 22 may further pass through a discharge area (not shown) having a lamp or other light source for exposing the entire photoconductor surface to light to remove any residual charge and image pattern formed by the laser 70.

As illustrated in FIG. 1, the ITM belt 40 is endless and extends around a series of rollers adjacent to the photoconductors 22 of the various cartridges 20. The ITM belt 40 and each photoconductor 22 are synchronized by controller 60, via gears and the like well known in the art, so as to allow the toner from each cartridge 20 to precisely align on the ITM belt 40 during a single pass. By way of example as viewed in FIG. 1, the yellow toner will be placed on the ITM belt 40, followed by cyan, magenta, and black. The purpose of the ITM belt 40 is to gather the image from the cartridges 20 and transport it to the sheet 5 to be printed on.

The paper 5 may be stored in paper supply tray 80 and supplied, via a suitable series of rollers, belts, and the like, to the location where the sheet 5 contacts the ITM belt 40. At this location, called the second transfer point (denoted Z in FIG. 1), the toner image on the ITM belt 40 is transferred to the sheet 5. If desired, the sheet 5 may receive an electrostatic charge prior to contact with the ITM belt 40 to assist in attracting the toner from the ITM belt 40. The sheet 5 and attached toner next travel through a fuser 50, typically a pair of rollers with an associated heating element, that heats and fuses the toner to the sheet 5. The paper 5 with the fused image is then transported out of the printer 10 for receipt by a user. After rotating past the second transfer point Z, the ITM belt 40 is cleaned of residual toner by an ITM cleaning assembly 45 so that the ITM belt 40 is clean again when it next approaches the first transfer point X.

A first aspect of the present invention addresses the problem of toner leakage proximate the cleaning assembly 28 associated with the photoconductor 22 (sometimes referred to as the "PC drum"). Referring to FIGS. 2–5, this cleaning assembly 28 may include a cleaning blade 90, a flexible seal 98, and one or more end seals 100. The cleaning blade 90 is typically a rectangular polyhedron having a front surface 91, a back surface 92, an upstream surface 93 (with respect to the rotational direction of the photoconductor 22 about a longitudinal axis 22*a* thereof), and a downstream surface 94. The upstream surface 93 includes cleaning edge 95 and a trailing edge 96. The cleaning edge 95 typically contacts the photoconductor 22 so as to remove residual toner therefrom. The cleaning blade 90 may be held in place by any means known in the art, typically with the downstream portion of the cleaning blade 90 held fixedly, such as captured between a portion of the cartridge housing and a rigid plate (not shown) screwed into the cartridge housing. The upstream portion of the cleaning blade 90 should be left free to deflect while pressing against the photoconductor 22. The cleaning blade 90 may be made from any suitable material, such as urethane or polyurethane. In general, numerous cleaning blades 90 and mounting approaches are known in the art, any one of which may be used, and the details of the cleaning blade 90 itself is not important to understanding the present invention.

The flexible seal 98 may be a thin strip of flexible material, such as polyethylene terephthalate. The flexible seal 98 extends from one end portion 22*e* (e.g., the left side) of the photoconductor 22 to the other. There is a gap between the cleaning blade 90 and the flexible seal 98 that allows residual toner removed from the photoconductor 22 to fall into a suitable capture reservoir, as is known in the art. In general, numerous flexible seals 98 are known in the art, any one of which may be used, and the details of the flexible seal 98 itself is not important to understanding the present invention.

The end seals 100 are disposed proximate the respective end portions 22*e* of the photoconductor 22 and generally disposed perpendicular to the longitudinal axis 22*a* of the photoconductor 22. The end seals 100 may be substantially similar in construction and configuration, with the right end seal 100 being a left-to-right mirror image of the left end seal 100. As such, the present description will focus on the left end seal 100 for clarity. The end seal 100 may include a blade portion 120, a middle portion 140, and an upstream portion 160. The blade portion 120 includes a recess forming a blade pocket 130 with an upstream wall 132 and a downstream wall 134. The blade pocket 130 is sized to mate with the corresponding end portion of the cleaning blade 90. The middle portion 140 includes an array 150 of small angled ridges (or grooves) 152. The ridges 152 extend inwardly at an acute angle $\alpha$ with respect to line L1

(representing a plane perpendicular to the longitudinal axis of the photoconductor). This angle α may be in the general range of 5° to 45°, and preferably about 35° to 45°, such as 38.6°. The array 150 includes at least three ridges 152, and more preferably ten or more, and the ridges 152 may substantially or entirely cover the surface of the middle portion 140 closest the photoconductor 22. The ridges 152 are small, with a depth D typically in the range of 0.05 to 0.3 mm, such as approximately 0.1 mm, and narrow spacing, such as 0.08 mm. The relatively small size of the ridges 152 is selected so as to avoid creating an escape route for the toner, as may happen if the ridges 152 are 0.3 mm or larger. The ridges 152 may have any suitable profile, such as a generally triangular profile with a sharp leading edge. The size and shape of the ridges 152 is selected to allow the ridges 152 to "snowplow" toner off the photoconductor 22 and urge the removed toner inward away from the end portions 22*e*. The upstream portion 160 may be an extension of the general plane of the middle portion 140, but should not include the ridges 152. This upstream portion 160 is intended to press against the backside of the flexible seal 98 and sandwich the flexible seal 98 between the upstream portion 160 of the end seal 100 and the photoconductor 22.

The end seal 100 may advantageously be, but is not required to be, formed of two distinct elements 110, 180, which are either readily separable or adhered together. The primary portion 110 of the seal 100 should be made from a hard, yet flexible material, with a low coefficient of friction, such as SANTOPRENE. This primary portion 110 is disposed closer to the photoconductor 22 and includes the blade pocket 130 and the ridge array 150. The secondary portion 180 of the seal 100 may be made from any suitable cushion material known in the art, such as urethane foam or polyurethane foam. The secondary portion 180 of the end seal 100 is intended to be compressed against the nearby housing so as to urge the primary portion 110 against the cleaning blade 90, the photoconductor 22, and the flexible seal 98; as such, the geometry of the secondary portion 180 will depend somewhat on the geometry of the associated housing. The secondary portion 180 may include a channel 182 or cut that is disposed near the boundary between the blade portion 120 and the middle portion 140, but is advantageously within the area of the middle portion 140. This channel 182 runs generally radially outward from the perspective of the photoconductor 22 and helps provide stress relief so that the respective portions of the primary portion 110 are urged in the correct direction. The secondary portion 180 may include another channel 184 or cut that is disposed towards the downstream portion of the blade portion 120. This channel 184 runs generally radially inward from the perspective of the photoconductor 22 and may help provide stress relief so that the respective portions of the primary portion 110 are urged in the correct direction. In addition, the channel 184 may help align the secondary portion 180 within the housing as necessary. To aid in aligning the primary portion 110 and the secondary portion 180, the primary portion 10 may include an alignment flange 170 outboard of the secondary portion 180. This flange 170 may also serve to strengthen the primary portion 110 in the upstream area of the blade pocket 130.

Figure 2:
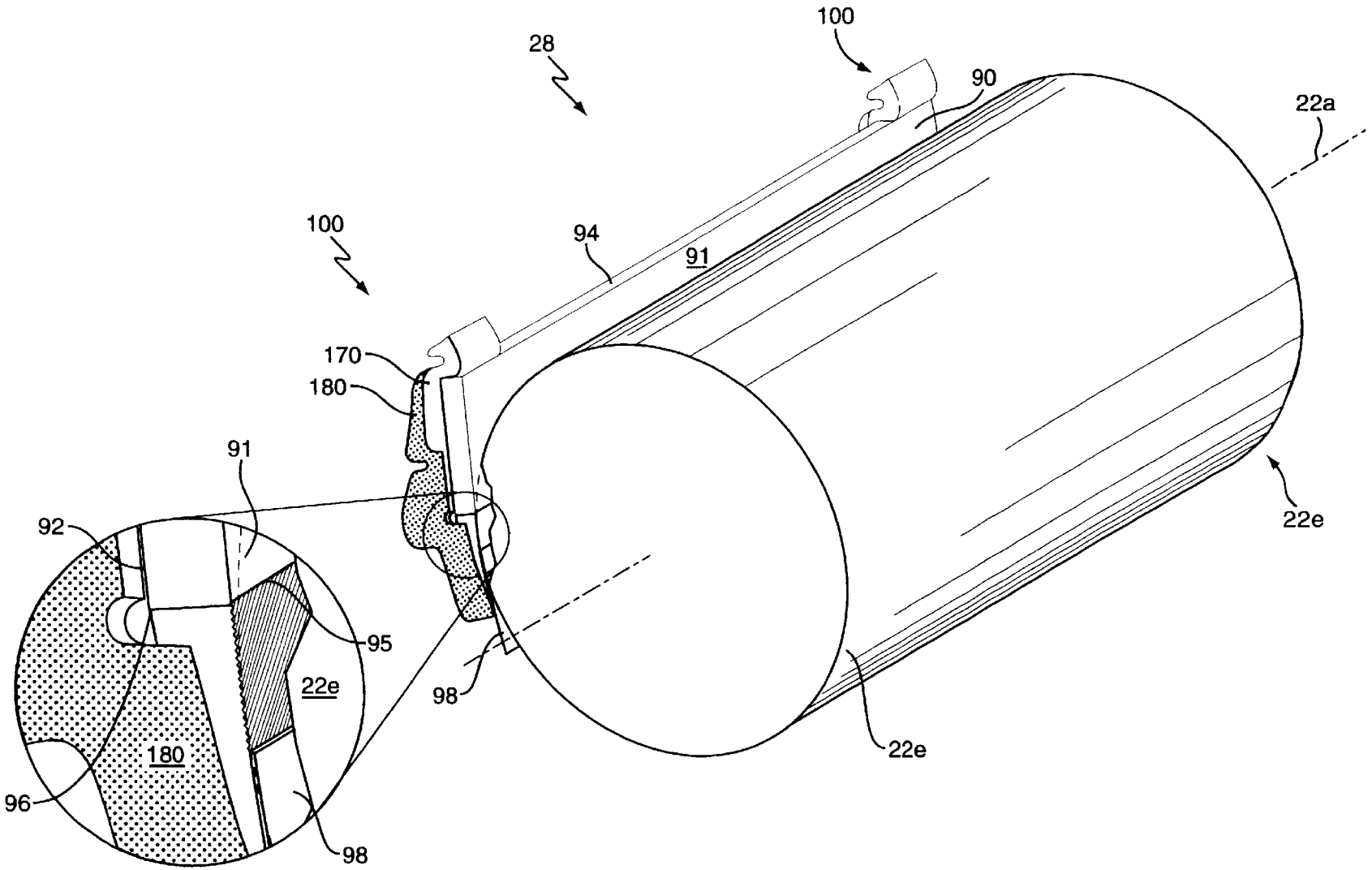
FIG. 2 shows perspective view of a photoconductive drum cleaning assembly employing one embodiment of the end seal according to the present invention.
Figure 3:
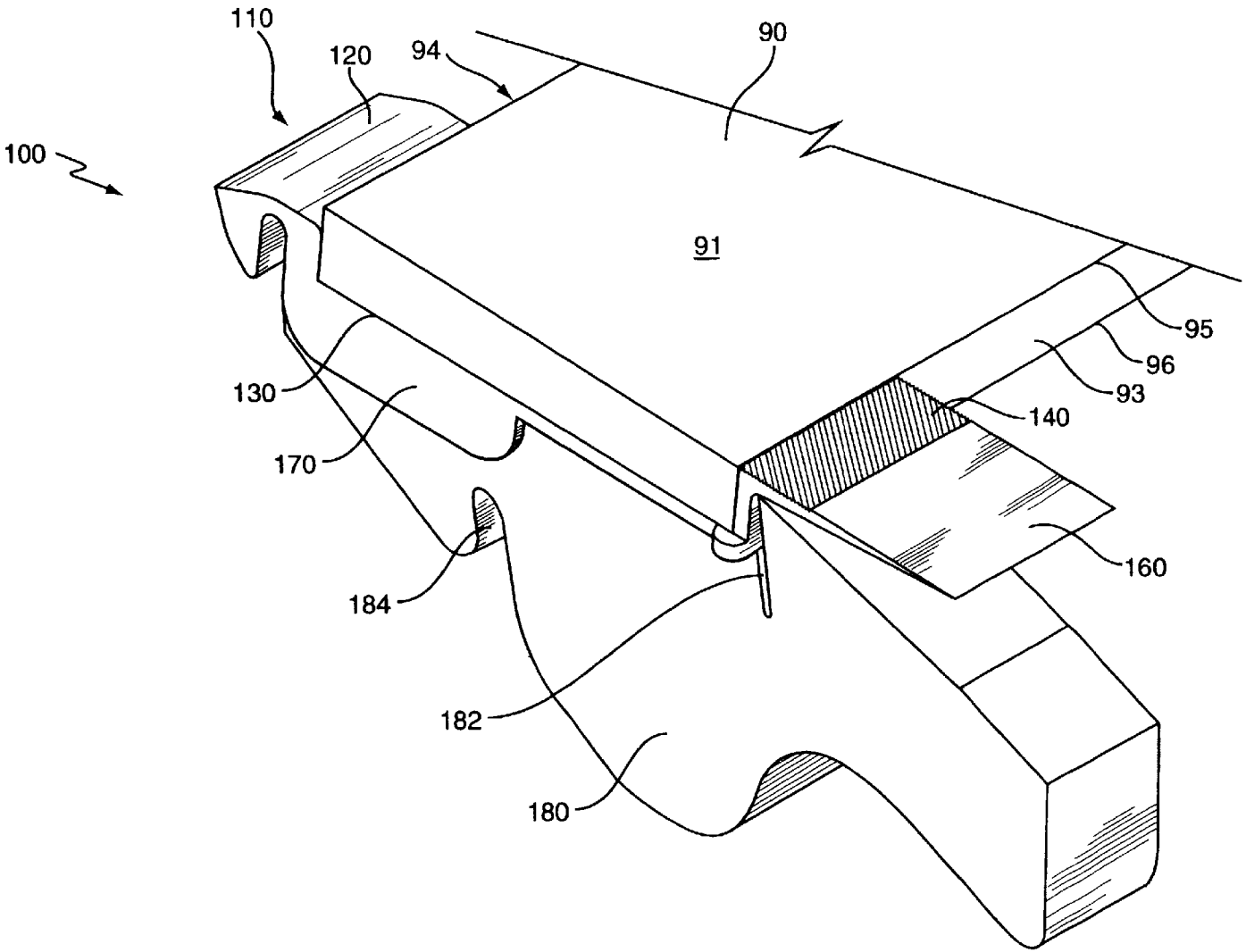
FIG. 3 shows a more detailed view of the end seal of FIG. 2 in an undeflected state.
Figure 4:
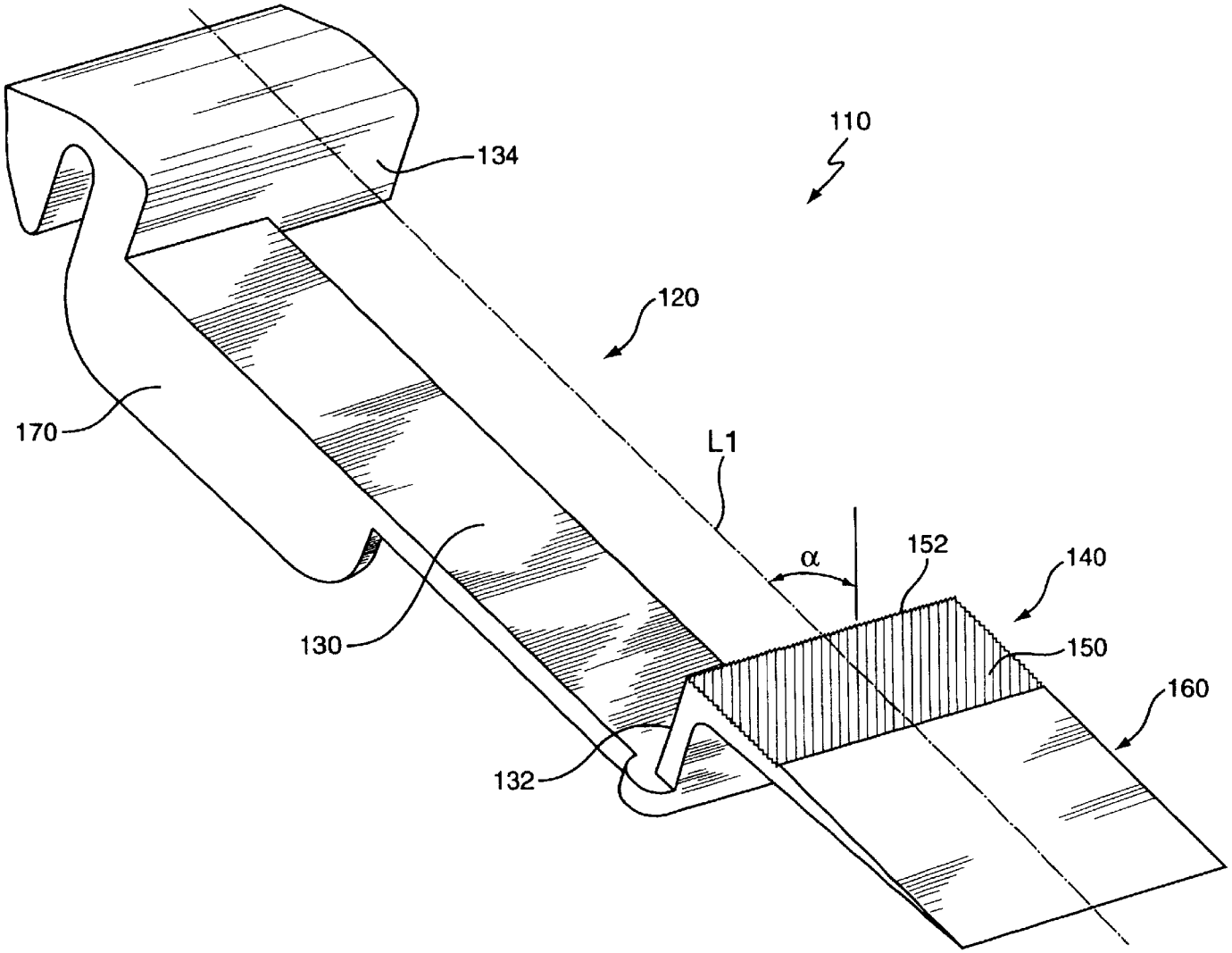
FIG. 4 shows the primary portion of the end seal of FIG. 3.
Figure 9:
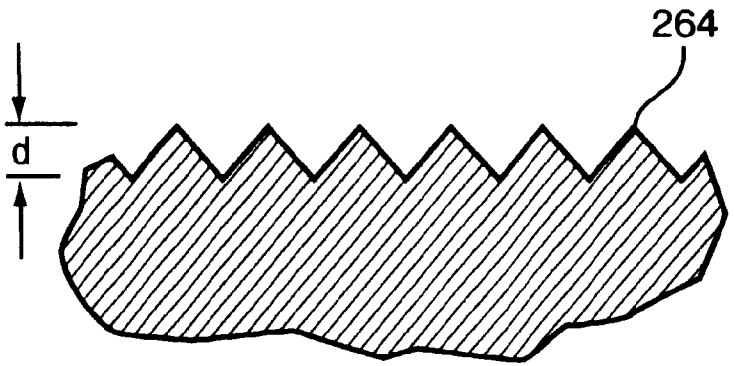
FIG. 9 shows one possible profile for the ridges on the end seal of FIG. 7.
Figure 5:
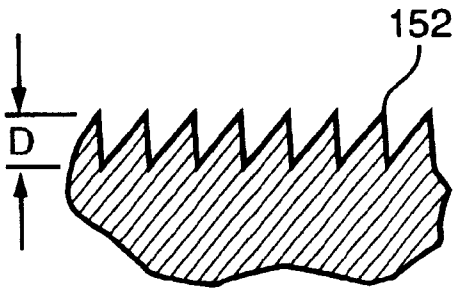
FIG. 5 shows one possible profile for the ridges on the end seal of FIG. 4.
Figure 6:
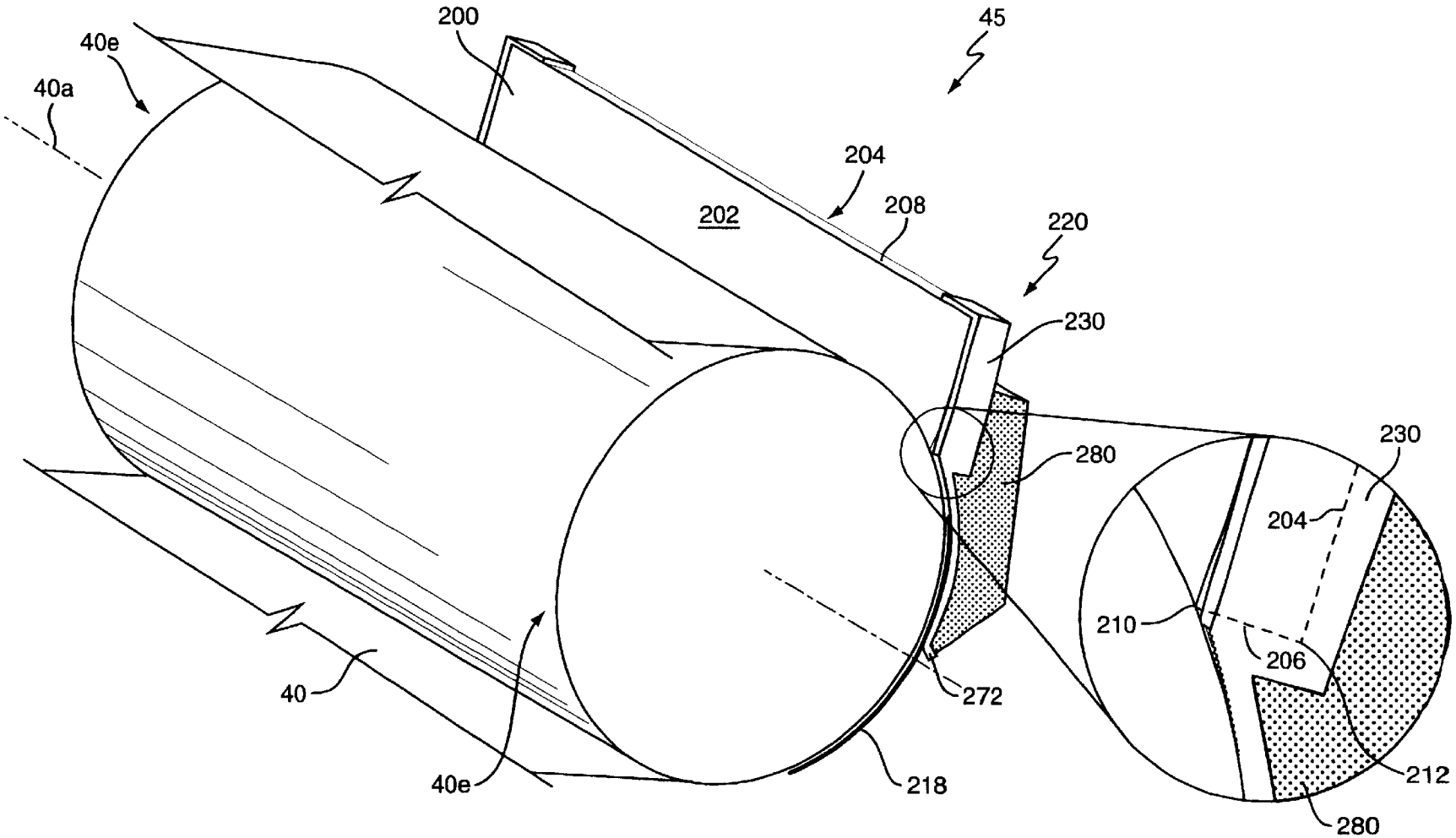
FIG. 6 shows a perspective view of an ITM cleaning assembly employing one embodiment of the end seal according to the present invention.
Figure 7:
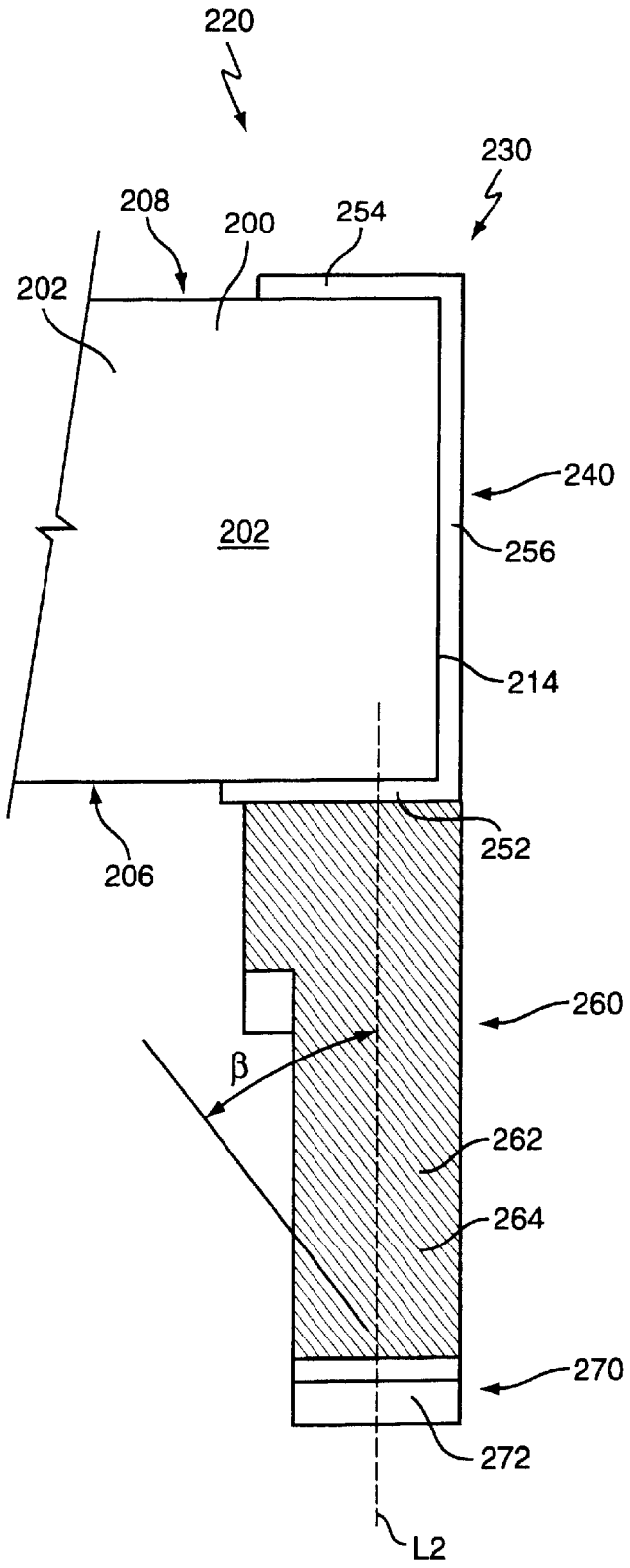
FIG. 7 shows a front view of the cleaning assembly of FIG. 6 with the ITM removed.
Figure 8:
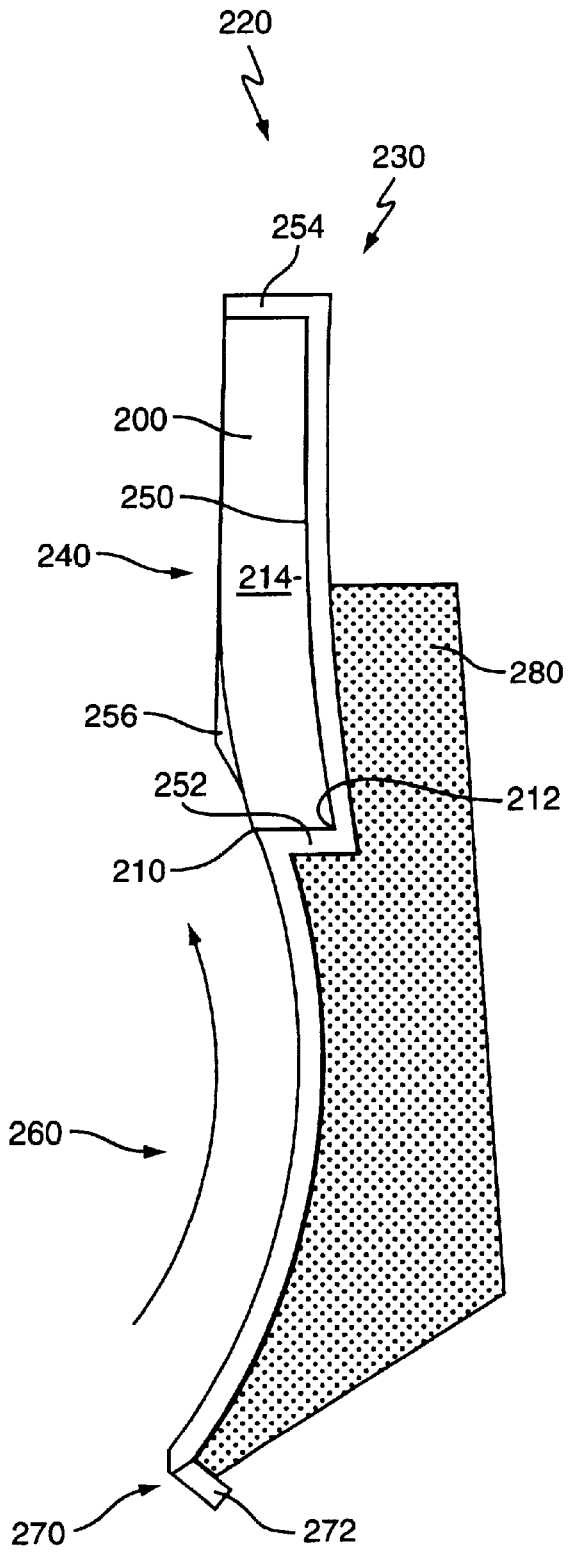
FIG. 8 shows a side view of the cleaning assembly of FIG. 7 with the outboard wall removed to show the cleaning blade pocket.

The purpose of the end seals 100 is to help prevent toner from escaping around the end portions 22*e* of the photoconductor 22. As discussed above, the cleaning blade 90 removes (e.g., scrapes) toner off the photoconductor 22. The blade pocket 130 of the respective end seals 100 help seal the respective end portions of the cleaning blade 90. In particular, the blade pocket 130 contacts at least a portion of the back surface 92 and the downstream surface 94 of the cleaning blade 90 so as to form a seal therebetween. The cleaning edge 95 of the upstream surface 93 of the cleaning blade 90 is deflected from its static position as shown in FIG. 3 when photoconductor 22 is installed, thereby flexing the cleaning blade 90, the seal portions 110 and 180 and the flexible seal 98 as shown in FIG. 2. The back surface 92 and the trailing edge 96 of the cleaning blade 90 is thus urged into contact against the black surface 130 of the blade pocket 120. The ridge array 150 of the middle portion 140 of the end seal 100 is urged against the photoconductor 22 by the compression of the secondary portion 180, thereby being dragged by the rotating photoconductor 22 so as to press the upstream wall 132 of the blade pocket 120 tightly against the upstream surface 93 of the cleaning blade 90. Thus, toner is prevented from escaping around the ends of the cleaning blade 90. The ridge array 150 of the middle portion 140 of the end seal 100 is urged against the photoconductor 22. Any residual toner in the corresponding section of the photoconductor 22 is scraped off by the ridge array 150 and urged inwardly towards the gap between the cleaning blade 90 and the flexible seal 98. These corresponding side areas of the photoconductor 22 are typically outside the "printable area" of the photoconductor 22 and may therefor have less toner adhered thereto. Indeed, most of the toner is this area may be "old" residual toner that somehow was not fully removed by the cleaning blade 90. This "snowplow" action of the ridge array 150 is specifically designed to help prevent sideways migration of toner outside the end seals 100, thereby helping to ensure that the waste toner is properly contained.

A second aspect of the present invention addresses the problem of toner leakage proximate the cleaning assembly 45 associated with the ITM 40. For simplicity, the ITM 40 will be assumed to be in the form of a belt that rotates about a roller proximate the relevant cleaning assembly 45. Referring to FIGS. 6–9, this cleaning assembly 45 may include a cleaning blade 200 and one or more end seals 220. The cleaning blade 200 is typically a rectangular polyhedron having a front surface 202, a back surface 204, an upstream surface 206 (with respect to the rotational direction of the ITM belt 40 about a longitudinal axis of the roller), a downstream surface 208, and respective side-end faces 214 (the side-end faces adjacent the other four surfaces). The upstream surface 206 includes cleaning edge 210 and a trailing edge 212. The cleaning edge 210 typically contacts the ITM belt 40 so as to remove residual toner therefrom. The cleaning blade 200 may be held in place by any means known in the art, typically with the downstream portion of the cleaning blade 200 held fixedly, such as captured between a portion of the printer housing and a rigid plate (not shown) screwed into the printer housing. The upstream portion of the cleaning blade 200 should be left free to deflect while pressing against the ITM belt 40. The cleaning blade 200 may be made from any suitable material, such as urethane or polyurethane. In general, numerous cleaning blades 200 are known in the art, any one of which may be used, and the details of the cleaning blade 200 itself is not important to understanding the present invention.

The optional flexible seal 218 may be a thin strip of flexible material, such as polyethylene terephthalate. The flexible seal 218 extends from one side of the ITM belt 40 to the other. There is a gap between the cleaning blade 200 and the flexible seal 218 that allows residual toner removed from the ITM belt 40 to fall into a suitable capture reservoir, as is known in the art. In general, numerous flexible seals 218 are known in the art, any one of which may be used, and the details of the flexible seal 218 itself is not important to understanding the present invention.

The end seals 220 are disposed proximate the respective end portions 40*e* of the ITM belt 40 as it wraps around the roller. The end seals 220 are generally disposed perpendicular to the longitudinal axis 40*a* of the ITM belt 40 in this area. The end seals 220 may be substantially similar in construction and configuration, with the right end seal 220 being a left-to-right mirror image of the left end seal 220. As such, the present description will focus on the left end seal 220 for clarity. The end seal 220 may include a blade portion 240, a middle portion 260, and an optional upstream portion 270. The blade portion 240 includes a recess forming a blade pocket 250 with an upstream wall 252, a downstream wall 254, and an outboard wall 256. The blade pocket 250 is sized to mate with the corresponding end portion of the cleaning blade 200. The middle portion 260 includes an array 262 of small angled ridges 264 (or grooves) on a curved surface that extends in an arc around the ITM belt 40. The arc length may advantageously be in the range of 45° to 85°, and more advantageously approximately 65°. The ridges 264 extend inwardly at an acute angle β with respect to line L2 (representing a plane perpendicular to the longitudinal axis of the ITM belt 40). This angle β may be in the general range of 5° to 60°, and preferably about 25° to 30°, such as 27.4°. The array 262 includes at least three ridges 264, and more preferably ten or more, and the ridges 264 may substantially or entirely cover the surface of the middle portion 260 closest the ITM belt 40. The ridges 264 are small, with a depth "d" typically in the range of 0.05 to 0.3 mm, such as approximately 0.1 mm, with a spacing of approximately 0.2 mm. The relatively small size of the ridges 264 is selected so as to avoid creating an escape route for the toner, as may happen if the ridges 264 are 0.5–1 mm or larger. The ridges 264 may have any suitable profile, such as a triangular profile with a sharp leading edge. The size and shape of the ridges 264 is selected to allow the ridges 264 to "snowplow" off the ITM belt 40 and urge the removed toner inward away from the end portions 40*e*. The upstream portion 270 may include a hook portion 272 for aid in properly locating the end seal 220. The upstream portion 270 may optionally also press against the backside of the flexible seal 218 and sandwich the flexible seal 218 between the upstream portion of the end seal 220 and the ITM belt 40.

The end seal 220 may advantageously be, but is not required to be, formed of two distinct elements 230, 280, which are either readily separable or adhered together. The primary portion 230 of the seal 220 should be made from a hard, yet flexible material, with a low coefficient of friction, such as SANTOPRENE. This primary portion 230 is disposed closer to the ITM belt 40 and includes the blade pocket 250 and the ridge array 262. The secondary portion 280 of the seal 220 may be made from any suitable cushion material known in the art, such as polyether urethane. The secondary portion 280 of the end seal 220 is intended to be compressed against the nearby housing so as to urge the primary portion 230 against the cleaning blade 200, the ITM belt 40, and the optional flexible seal 218; as such, the geometry of the secondary portion 280 will depend somewhat on the geometry of the associated housing.

The purpose of the end seals 220 is to help prevent toner from escaping around the end portions of the ITM belt 40. As discussed above, the cleaning blade 200 removes (e.g., scrapes) toner off the ITM belt 40. The blade pocket 250 of the respective end seals 220 help seal the respective end portions of the cleaning blade 200. In particular, the blade pocket 250 contacts at least a portion of each of the back surface 204, the downstream surface 208, and the side-end face 214 of the cleaning blade 200 so as form a seal therebetween. The cleaning edge 210 of the upstream surface 206 of the cleaning blade 200 is dragged somewhat by the ITM belt 40, thereby flexing the cleaning blade 200. The trailing edge 212 of the cleaning blade 200 preferably rests against the upstream wall 252 of the blade pocket 250, and is forced tightly thereagainst by the dragging induced tilt of the cleaning blade's upstream surface 206. Thus, toner is prevented from escaping around the ends of the cleaning blade 200. The ridge array 262 of the middle portion 260 of the end seal 220 is urged against the ITM belt 40. Any residual toner in the corresponding section of the ITM belt 40 is scraped off by the ridge array 262 and urged inwardly towards the gap between the cleaning blade 200 and the flexible seal 218. These corresponding side areas of the ITM belt 40 are typically outside the "printable area" of the ITM belt 40 and may therefor have less toner adhered thereto. Indeed, most of the toner is this area may be "old" residual toner that somehow was not fuilly removed by the cleaning blade 200. This "snowplow" action of the ridge array 262 is specifically designed to help prevent sideways migration of toner outside the end seals 220, thereby helping to ensure that the waste toner is properly contained.

As used herein, the term "image forming apparatus" should be broadly construed; specifically including, but not limited to, laser printers, facsimile machines, copiers, and the like that use an electrophotographic image forming process of any variety.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. An electrophotographic printing assembly, comprising:

a photoconductive drum having a longitudinal axis and respective end portions and rotating in a first direction;

a cleaning blade disposed generally parallel to said photoconductive drum and adapted to remove toner from said photoconductive drum;

a first end seal disposed proximate one of said end portions of said photoconductive drum and biased to contact said photoconductive drum and said cleaning blade, said first end seal having:

a first portion in contact with said photoconductive drum and disposed upstream of said cleaning blade;

an array of at least three small angled ridges formed on said first portion and running at an inward acute angle with respect a plane that is perpendicular to said longitudinal axis; and said ridges co-operating with said photoconductive drum to capture toner therebetween and direct said toner away from the respective end portion.

2. The assembly of claim 1 wherein said array substantially covers said first portion.

3. The assembly of claim 1 wherein said ridges have a depth of not more than 0.2 mm.

4. The assembly of claim 1 wherein said ridges have a substantially triangular profile.

5. The assembly of claim 1 wherein said end seal further comprises a blade pocket downstream of said first portion, said blade pocket adapted to accept said cleaning blade.

6. The assembly of claim 5 wherein said cleaning blade comprises a back surface, a front surface opposite said back surface, an upstream surface, and a downstream surface, and wherein said blade pocket contacts said cleaning blade along at least a portion of said back surface and said downstream surface.

7. The assembly of claim 6 wherein said cleaning blade further comprises a cleaning edge where said front surface and said upstream surface intersect and a trailing edge where said back surface and said upstream surface intersect, and wherein said blade pocket contacts said cleaning blade at least along a portion of said trailing edge to form a toner seal therebetween.

8. The assembly of claim 1 wherein said end seal comprises at least a first and second elements made from different materials, said first element disposed generally closer to said photoconductive drum than said second element, said second element being more compliant than said first element and biasing said first element into contact with said photoconductive drum.

9. The assembly of claim 8 wherein said first element and said second element are distinct from one another.

10. The assembly of claim 8 wherein said first element includes a blade pocket downstream of said first portion, said blade pocket adapted to accept said cleaning blade.

11. The assembly of claim 8 wherein said second element comprises a first stress relief channel extending partially therethrough disposed between an upstream and a downstream edge of said first portion.

12. The assembly of claim 11 wherein said first stress relief channel is disposed proximate said downstream edge of said first portion.

13. The assembly of claim 8 wherein said first element includes a blade pocket downstream of said first portion, said blade pocket adapted to accept said cleaning blade, and wherein said second element comprises a second stress relief channel extending partially therethrough disposed between an upstream and a downstream wall of said blade pocket.

14. The assembly of claim 13 wherein said first stress relief channel is disposed closer to said downstream edge of said first portion than said upstream edge of said blade pocket.

15. The assembly of claim 8 wherein:

wherein said first element includes a blade pocket downstream of said first portion, said blade pocket adapted to accept said cleaning blade;

said second element comprises a first stress relief channel extending partially therethrough disposed between an upstream and a downstream edge of said first portion wherein said second element comprises a second stress relief channel extending partially therethrough disposed between an upstream and a downstream edge of said blade pocket;

said first stress relief channel is disposed proximate said downstream edge of said first portion; and said first stress relief channel is disposed closer to said downstream edge of said first portion than said upstream edge of said blade pocket.

16. The assembly of claim 1 further comprising a flexible strip disposed generally parallel to said longitudinal axis and contacting said photoconductive drum upstream of said first portion, said end seal further comprising a second portion disposed upstream of said first portion, said second portion separated from said photoconductive drum by said flexible strip and sealing a backside portion of said flexible strip against toner escape.

17. The assembly of claim 8 wherein said first element comprises an alignment flange disposed outboard of said second element.

18. The assembly of claim 1 further comprising a second end seal disposed proximate another one of said end portions of said photoconductive drum and biased to contact said photoconductive drum and said cleaning blade, said second end seal having:

a first portion in contact with said photoconductive drum and disposed upstream of said cleaning blade;

an array of at least three small angled ridges formed on said first portion and running at an inward acute angle with respect a plane that is perpendicular to said longitudinal axis; and said ridges co-operating with said photoconductive drum to capture toner therebetween and direct said toner away from the respective end portion.

19. The assembly of claim 18 wherein said second end seal is a mirror image of said first end seal.

20. An electrophotographic printing assembly, comprising:

a photoconductive drum having a longitudinal axis and respective end portions and rotating in a first direction;

a cleaning blade disposed generally parallel to said photoconductive drum and adapted to remove toner from said photoconductive drum; said cleaning blade comprising a back surface, a front surface opposite said back surface, an upstream surface, and a downstream surface; said cleaning blade further comprising a cleaning edge where said front surface and said upstream surface intersect and a trailing edge where said back surface and said upstream surface intersect;

a first end seal disposed proximate one of said end portions of said photoconductive drum and biased to contact said photoconductive drum and said cleaning blade, said first end seal having:

a first portion in contact with said photoconductive drum and disposed upstream of said cleaning blade;

an array of at least three small angled ridges formed on said first portion and running at an inward acute angle with respect a plane that is perpendicular to said longitudinal axis, said array substantially covering said first portion;

said ridges co-operating with said photoconductive drum to capture toner therebetween and direct said toner away from the respective end portion;

a second portion disposed upstream of said first portion;

a blade pocket downstream of said first portion, said blade pocket adapted to accept said cleaning blade to form a toner seal therebetween; said blade pocket contacting said cleaning blade:

along at least a portion of said back surface;

along at least a portion of said downstream surface;

along at least a portion of said trailing edge;

a flexible strip disposed generally parallel to said longitudinal axis and contacting said photoconductive drum upstream of said first portion, said second portion separated from said photoconductive drum by said flexible strip and sealing a backside portion of said flexible strip against toner escape.

21. The assembly of claim 20 wherein:

said first end seal comprises at least a first and second elements made from different materials and distinct from one another, said first element disposed generally closer to said photoconductive drum than said second element, said second element being more compliant than said first element and biasing said first element into contact with said photoconductive drum;

wherein said first element includes said blade pocket;

said second element comprises a first stress relief channel extending partially therethrough disposed between an upstream and a downstream edge of said first portion and proximate said downstream edge of said first portion; and wherein said second element comprises a second stress relief channel extending partially therethrough disposed between an upstream and a downstream edge of said blade pocket and closer to said downstream edge of said first portion than said upstream edge of said blade pocket.

22. The assembly of claim 20 wherein said ridges have a nominal depth of not more than about 0.20 mm.

23. The assembly of claim 22 wherein said ridges have a nominal depth of approximately 0.1 mm.

24. The assembly of claim 20 further comprising a second end seal being substantially a mirror image of said first end seal, said second end seal disposed proximate another one of said end portions of said photoconductive drum and contacting said photoconductive drum and said cleaning blade in a like manner as said first end seal contacts said photoconductive drum and said cleaning blade.

25. A seal for an electrophotographic printing apparatus having a photoconductive drum and a cleaning blade adapted to remove toner from said photoconductive drum, said cleaning blade comprising a back surface, a front surface opposite said back surface, an upstream surface, and a downstream surface, said seal comprising:

first and second elements made from different materials;

said first element comprising:

proximal and distal portions and a central axis running therebetween;

inboard and outboard sides disposed on opposing sides of said central axis;

said distal portion having an array of at least three small angled ridges formed thereon and running at an acute angle with respect to said central axis towards said inboard side, said ridges adapted to co-operate with the photoconductive drum to capture toner therebetween and direct said toner towards said inboard side;

said proximal portion having a blade pocket recess adapted to accept the cleaning blade, said blade pocket recess having a generally U-shaped cross section, wherein said blade pocket recess contacts the cleaning blade along at least a portion of the back surface and the downstream surface to form a toner seal therebetween;

said second element being more compliant than said first element and comprising:

a first stress relief channel extending partially therethrough proximate with a boundary between said distal and proximal portions of said first element.

26. The seal of claim 25 wherein said ridges have a depth of not more than about 0.2 mm.

27. The seal of claim 25 wherein said second element further comprises a second stress relief channel extending partially therethrough proximate a proximal end of said blade pocket of said first element.

28. The seal of claim 25 wherein said first element and said second element are distinct from one another.

29. The seal of claim 25 wherein the cleaning blade further comprises a cleaning edge where the front and upstream surfaces thereof intersect and a trailing edge where the back and upstream surfaces thereof intersect, and wherein said blade pocket recess contacts the cleaning blade at least along a portion of the trailing edge to form a toner seal therebetween.

30. A method of minimizing toner escape in an electrophotographic printing assembly, comprising:

rotating a photoconductive drum having a longitudinal axis and respective end portions in a first direction;

removing toner from said photoconductive drum with a cleaning blade disposed generally parallel to said photoconductive drum;

placing a first end seal disposed proximate one of said end portions of said photoconductive drum into contact said photoconductive drum and said cleaning blade, said first end seal having:

a first portion in contact with said photoconductive drum and disposed upstream of said cleaning blade;

an array of at least three small angled ridges formed on said first portion and running at an inward acute angle with respect a plane that is perpendicular to said longitudinal axis;

a blade pocket disposed downstream of said first portion and adapted to accept said cleaning blade therein; and directing toner, by said ridges, inward away from said first end seal and generally parallel to said longitudinal axis.

31. An electrophotographic printing assembly, comprising:

an intermediate transfer medium having a longitudinal axis and respective end portions and rotating in a first direction;

a cleaning blade disposed generally parallel to said intermediate transfer medium and adapted to remove toner from said intermediate transfer medium;

a first end seal disposed proximate one of said end portions of said intermediate transfer medium and biased to contact said intermediate transfer medium and said cleaning blade, said first end seal having:

a first portion in contact with said intermediate transfer medium and disposed upstream of said cleaning blade;

an array of at least three small angled ridges formed on said first portion and running at an inward acute angle with respect a plane that is perpendicular to said longitudinal axis, said array substantially covering said first portion; and said ridges co-operating with said intermediate transfer medium to capture toner therebetween and direct said toner away from the respective end portion.

32. The assembly of claim 31 wherein said array substantially covers said first portion.

33. The assembly of claim 31 wherein said ridges have a depth of not more than about 0.2 mm.

34. The assembly of claim 31 wherein said ridges have a substantially triangular profile.

35. The assembly of claim 31 wherein said end seal further comprises a blade pocket downstream of said first portion, said blade pocket adapted to accept said cleaning blade.

36. The assembly of claim 35 wherein said cleaning blade comprises a back surface, a front surface opposite said back surface, an upstream surface, and a downstream surface, and wherein said blade pocket contacts said cleaning blade along at least a portion of said back surface and said downstream surface.

37. The assembly of claim 36 wherein said cleaning blade further comprises a cleaning edge where said front surface and said upstream surface intersect and a trailing edge where said back surface and said upstream surface intersect, and wherein said blade pocket contacts said cleaning blade at least along a portion of said trailing edge to form a toner seal therebetween.

38. The assembly of claim 36 wherein said cleaning blade further comprises an side-end face adjacent said back and front surfaces of said cleaning blade, and wherein said blade pocket further contacts said cleaning blade along at least a portion of said side-end face.

39. The assembly of claim 38 wherein said blade pocket further contacts said cleaning blade along said side-end face from said downstream surface to at least a point proximate said upstream surface.

40. The assembly of claim 31 wherein said end seal comprises at least a first and second elements made from different materials, said first element disposed generally closer to said intermediate transfer medium than said second element, said second element being more compliant than said first element and biasing said first element into contact with said intermediate transfer medium.

41. The assembly of claim 40 wherein said first element and said second element are distinct from one another.

42. The assembly of claim 40 wherein said first element includes a blade pocket downstream of said first portion, said blade pocket adapted to accept said cleaning blade.

43. The assembly of claim 31 further comprising a second end seal disposed proximate another one of said end portions of said intermediate transfer medium and biased to contact said intermediate transfer medium and said cleaning blade, said second end seal having:

a first portion in contact with said intermediate transfer medium and disposed upstream of said cleaning blade;

an array of at least three small angled ridges formed on said first portion and running at an inward acute angle with respect a plane that is perpendicular to said longitudinal axis; and said ridges co-operating with said intermediate transfer medium to capture toner therebetween and direct said toner away from the respective end portion.

44. The assembly of claim 43 wherein said second end seal is a mirror image of said first end seal.

45. An electrophotographic printing assembly, comprising:

an intermediate transfer medium having a longitudinal axis and respective end portions and rotating in a first direction;

a cleaning blade disposed generally parallel to said intermediate transfer medium and adapted to remove toner from said intermediate transfer medium; said cleaning blade comprising a back surface, a front surface opposite said back surface, an upstream surface, a downstream surface, and an side-end face adjacent said back and front surfaces of said cleaning blade, said cleaning blade further comprising a cleaning edge where said front surface and said upstream surface intersect and a trailing edge where said back surface and said upstream surface intersect;

an first end seal disposed proximate one of said end portions of said intermediate transfer medium and biased to contact said intermediate transfer medium and said cleaning blade, said first end seal having:

a first portion in contact with said intermediate transfer medium and disposed upstream of said cleaning blade;

an array of at least three small angled ridges formed on said first portion and running at an inward acute angle with respect a plane that is perpendicular to said longitudinal axis, said array substantially covering said first portion;

said ridges co-operating with said intermediate transfer medium to capture toner therebetween and direct said toner away from the respective end portion;

a blade pocket downstream of said first portion, said blade pocket adapted to accept said cleaning blade to form a toner seal therebetween; said blade pocket contacting said cleaning blade:

along at least a portion of said back surface;

along at least a portion of said downstream surface;

along at least a portion of said trailing edge;

along at least a portion of said side-end face.

46. The assembly of claim 45 wherein:

said first end seal comprises at least a first and second elements made from different materials and distinct from one another, said first element disposed generally closer to said intermediate transfer medium than said second element, said second element being more compliant than said first element and biasing said first element into contact with said intermediate transfer medium;

wherein said first element includes said blade pocket.

47. The assembly of claim 45 wherein said ridges have a nominal depth of not more than about 0.2 mm.

48. The assembly of claim 45 further comprising a second end seal being substantially a mirror image of said first end seal, said second end seal disposed proximate another one of said end portions of said intermediate transfer medium and contacting said intermediate transfer medium and said cleaning blade in a like manner as said first end seal contacts said intermediate transfer medium and said cleaning blade.

49. A seal for an electrophotographic printing apparatus having a intermediate transfer medium and a cleaning blade adapted to remove toner from said intermediate transfer medium, said cleaning blade comprising a back surface, a front surface opposite said back surface, an upstream surface, a downstream surface, and respective side-end faces adjacent the back and front surfaces, said seal comprising:

first and second elements made from different materials;

said first element comprising:

proximal and distal portions and a central axis running therebetween;

inboard and outboard sides disposed on opposing sides of said central axis;

said distal portion having an array of at least three small angled ridges formed thereon and running at an acute angle with respect to said central axis towards said inboard side, said ridges adapted to co-operate with the intermediate transfer medium to capture toner therebetween and direct said toner towards said inboard side;

said proximal portion having a blade pocket adapted to accept the cleaning blade, wherein said blade pocket contacts the cleaning blade along at least a portion of the back surface and the downstream surface, and along one of the side-end faces, to form a toner seal therebetween;

said second element being more compliant than said first element.

50. The seal of claim 49 wherein said ridges have a depth of not more than 0.5 mm.

51. The seal of claim 49 wherein said first element and said second element are distinct from one another.

52. The seal of claim 49 wherein the cleaning blade further comprises a cleaning edge where the front and upstream surfaces thereof intersect and a trailing edge where the back and upstream surfaces thereof intersect, and wherein said blade pocket contacts the cleaning blade at least along a portion of the trailing edge to form a toner seal therebetween.

53. A method of minimizing toner escape in an electrophotographic printing assembly, comprising:

rotating a intermediate transfer medium having a longitudinal axis and respective end portions in a first direction;

removing toner from said intermediate transfer medium with a cleaning blade disposed generally parallel to said photoconductive drum;

placing a first end seal disposed proximate one of said end portions of said intermediate transfer medium into contact said intermediate transfer medium and said cleaning blade, said first end seal having:

a first portion in contact with said intermediate transfer medium and disposed upstream of said cleaning blade;

an array of at least three small angled ridges formed on said first portion and running at an inward acute angle with respect a plane that is perpendicular to said longitudinal axis;

a blade pocket disposed downstream of said first portion and adapted to accept said cleaning blade therein; and directing toner, by said ridges, inward away from said first end seal and generally parallel to said longitudinal axis.

* * * * *